US008565661B2

(12) United States Patent
Okamoto et al.

(10) Patent No.: US 8,565,661 B2
(45) Date of Patent: Oct. 22, 2013

(54) CLEANING DEVICE INCLUDING CLEANING MECHANISM HAVING NOISE REDUCTION MECHANISM AND IMAGE FORMING APPARATUS INCORPORATING SAME

(75) Inventors: Michiya Okamoto, Zama (JP); Hiroyuki Nagashima, Yokohama (JP); Fumihito Itoh, Kawasaki (JP); Hiroshi Ono, Tokyo (JP); Ken Amemiya, Tokyo (JP); Masahiko Shakuto, Zama (JP); Toshio Koike, Machida (JP); Yuji Arai, Kawasaki (JP); Kaoru Yoshino, Tokyo (JP); Takuma Iwasaki, Ebina (JP)

(73) Assignee: Ricoh Company, Ltd., Tokyo (JP)

( * ) Notice: Subject to any disclaimer, the term of this patent is extended or adjusted under 35 U.S.C. 154(b) by 333 days.

(21) Appl. No.: 12/585,635

(22) Filed: Sep. 21, 2009

(65) Prior Publication Data

US 2010/0074665 A1 Mar. 25, 2010

(30) Foreign Application Priority Data

Sep. 22, 2008 (JP) ..... 2008-242328

(51) Int. Cl.
*G03G 21/00* (2006.01)

(52) U.S. Cl.
USPC ..... 399/351; 399/123; 399/249; 399/343; 399/350

(58) Field of Classification Search
USPC ..... 399/350, 351
See application file for complete search history.

(56) References Cited

U.S. PATENT DOCUMENTS

| | | | | |
|---|---|---|---|---|
| 6,701,123 | B2 * | 3/2004 | Endo et al. | 399/350 |
| 6,836,639 | B2 * | 12/2004 | Karakama et al. | 399/351 |
| 7,974,565 | B2 * | 7/2011 | Hozumi et al. | 399/351 |
| 2005/0100374 | A1 * | 5/2005 | Satoh et al. | 399/350 |
| 2008/0175618 | A1 * | 7/2008 | Nakano et al. | 399/101 |
| 2008/0240812 | A1 * | 10/2008 | Yamashita | 399/351 |
| 2009/0097879 | A1 | 4/2009 | Nagashami et al. | |
| 2010/0247189 | A1 * | 9/2010 | Akamatsu et al. | 399/350 |

FOREIGN PATENT DOCUMENTS

| | | |
|---|---|---|
| JP | 06-194999 | 7/1994 |
| JP | 10-079128 | 3/1998 |
| JP | 10-097158 | 4/1998 |
| JP | 2000-132025 | 5/2000 |
| JP | 2002-230807 | 8/2002 |
| JP | 2003-084637 | 3/2003 |
| JP | 2003084637 A * | 3/2003 |

(Continued)

OTHER PUBLICATIONS

Japanese Office Action dated Nov. 5, 2012 for Japanese Application No. 2008-242328.

*Primary Examiner* — David Gray
*Assistant Examiner* — Francis Gray
(74) *Attorney, Agent, or Firm* — Harness, Dickey & Pierce, P.L.C.

(57) ABSTRACT

A cleaning device that can be incorporated in an image forming apparatus which includes an image carrier configured to form a toner image, and a cleaning device configured to clean residual toner on the surface of the image carrier. The cleaning device includes a cleaning blade having a blade member provided to contact the surface of the image carrier and a holder to hold the blade member. The cleaning device further includes a frame to hold the cleaning blade and a vibration suppression member provided across the cleaning blade and the frame to couple the cleaning blade and the frame together and suppress vibration.

19 Claims, 4 Drawing Sheets

(56) References Cited

FOREIGN PATENT DOCUMENTS

| | | | | | |
|---|---|---|---|---|---|
| JP | 2005-215163 | 8/2005 | | | |
| JP | 2005-338211 | 12/2005 | | | |
| JP | 2008111970 | A | * | 5/2008 | |
| JP | 2008249957 | A | * | 10/2008 | |

* cited by examiner

CLEANING DEVICE INCLUDING CLEANING MECHANISM HAVING NOISE REDUCTION MECHANISM AND IMAGE FORMING APPARATUS INCORPORATING SAME

This patent specification is based on Japanese patent application No. 2008-242328, filed on Sep. 22, 2008 in the Japan Patent Office, the entire contents of which are hereby incorporated by reference herein.

BACKGROUND OF THE INVENTION

1. Field of the Invention

The present invention relates to an image forming apparatus that includes a cleaning device having a noise reduction mechanism, and an image forming apparatus that incorporates the cleaning device.

2. Discussion of the Background

A background image forming apparatus using electrophotography generally includes a photosensitive drum serving as an image carrier. The surface of the photosensitive drum is charged by an electrical discharge method. The charged surface of the photosensitive drum is then exposed to a laser beam generated in accordance with image data to form an electrostatic latent image on the charged surface of the photosensitive drum. The electrostatic latent image is then rendered into a visible image with toner. The visible toner image formed on the photosensitive drum is transferred onto a recording medium (e.g., paper) through a transfer process and the image is fixed on the recording medium, after which the recording medium bearing a fixed image thereupon is output.

Such image forming apparatuses generally employ a cleaning device to remove any toner remaining on the surface of the photosensitive drum so that subsequent image processing is not affected by the residual toner. In so doing, noise may be generated due to friction between the photosensitive drum and the cleaning device.

More specifically, the friction between the photosensitive drum and a cleaning blade of the cleaning device causes the blade to alternately stick and slip, or chatter. The chatter causes vibration that becomes a source of high-pitched noise. Further, the vibration is transmitted from the cleaning blade to the frame (hereinafter referred to as the cleaning frame) that holds the cleaning blade. As a result, the cleaning frame generates noises (also called chatter).

The residual toner is an obstacle for a subsequent image forming process and needs to be removed before starting the next process. Accordingly, since the cleaning device is indispensable to remove the residual toner from the surface of the photosensitive drum, reduction of such noise is a must.

A variety of configurations are proposed to reduce such noise. For example, Japanese Patent Laid-Open Application Publication No. H10-97158-A describes a weight fixed in the photosensitive drum. With the weight, it is possible to avoid resonance in the photosensitive drum; however, it is not possible to avoid vibration of the cleaning blade. Accordingly, noise is still generated at the cleaning blade.

Japanese Patent Laid-Open Application Publication No. 2005-338211-A describes the cleaning blade having a different resonance frequency from the resonance frequency of the image carrier. Further, No. 2005-215163 describes that the vibration frequency generated by the chatter between cleaning blade and the image carrier is set to be different from the resonance frequency of the cleaning blade. However, when the vibration is transmitted to the cleaning frame from the cleaning blade, the cleaning frame generates noise.

Further, Japanese Patent Laid-Open Application Publication No. 2000-132025 describes a weight fixed to the cleaning blade by a screw. However, it is not a way to prevent the vibration of the cleaning blade: Accordingly, when the vibration is transmitted to the cleaning frame, the cleaning frame generates noise.

SUMMARY OF THE INVENTION

This patent specification describes a novel cleaning device that cleans residual toner remaining on an image carrier. The cleaning device includes a cleaning blade, a frame, and a vibration suppression member. The cleaning blade cleans the image carrier and includes a blade member provided to contact the surface of the image carrier, and a holder to hold the blade member. The frame holds the cleaning blade. The vibration suppression member is provided across the cleaning blade and the frame to couple the cleaning blade and the frame together.

The blade holder may include a weight and the vibration suppression member may be provided across the weight and the frame to couple the weight and the frame together.

The frame may have an opening portion and a weight may be attached at a leading edge of the opening portion at a center portion thereof in the axial direction of the image carrier.

The cleaning device may be integrally mounted with an image carrier configured to form a toner image disposed within a process cartridge removably installable in an image forming apparatus.

This patent specification further describes a novel image forming apparatus that includes an image carrier configured to form a toner image and the above-described cleaning device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
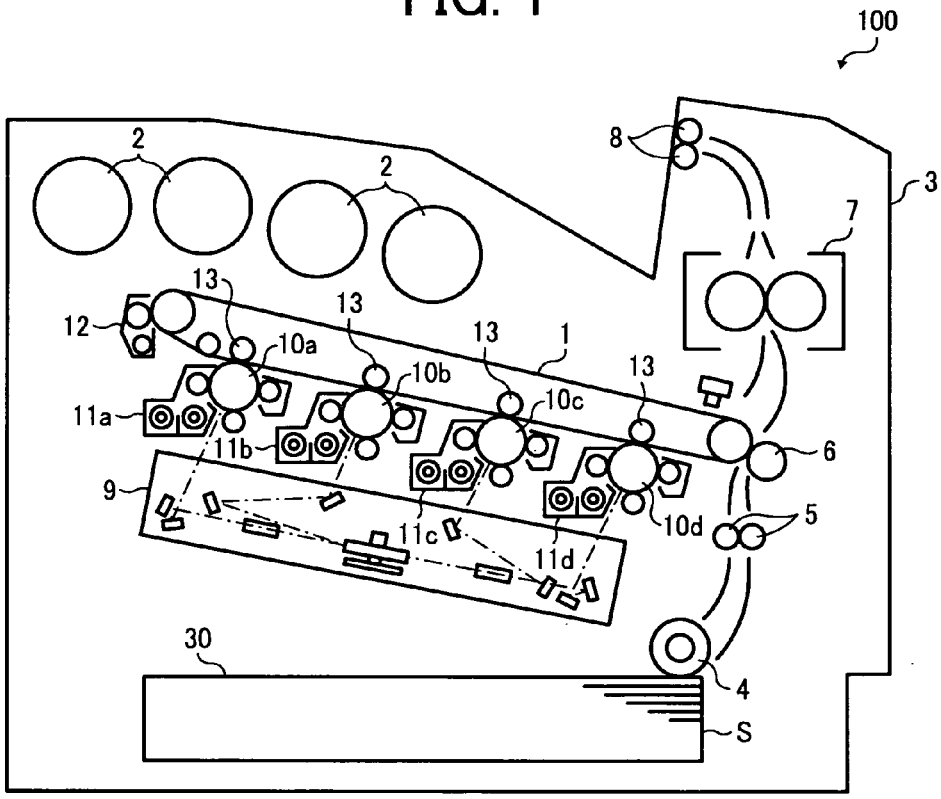
FIG. 1 is an overall view of an example of an image forming apparatus according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Figure 3:
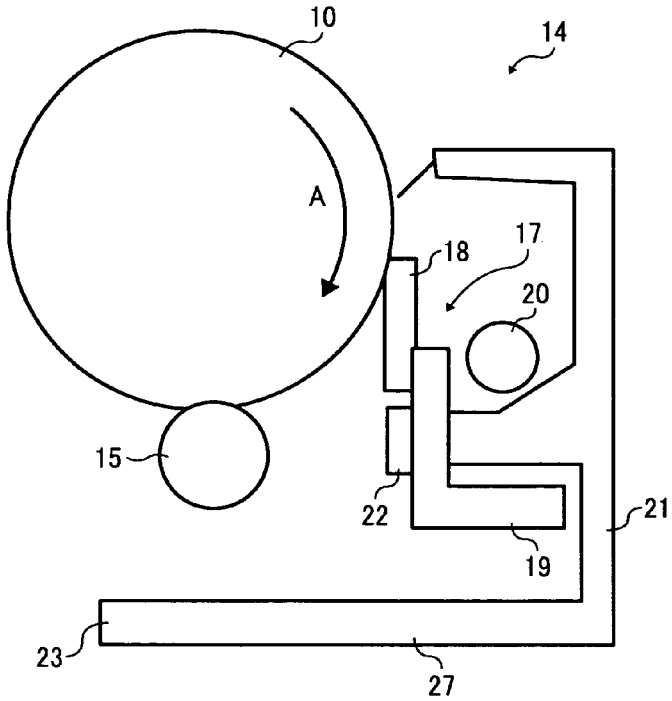
FIG. 3 is an overall view of an example of the cleaning device.

Referring now to the drawings, wherein like reference numerals designate identical or corresponding parts throughout the several views, particularly to FIG. 3, an image forming apparatus according to an exemplary embodiment of the present invention is described.

Figure 2:
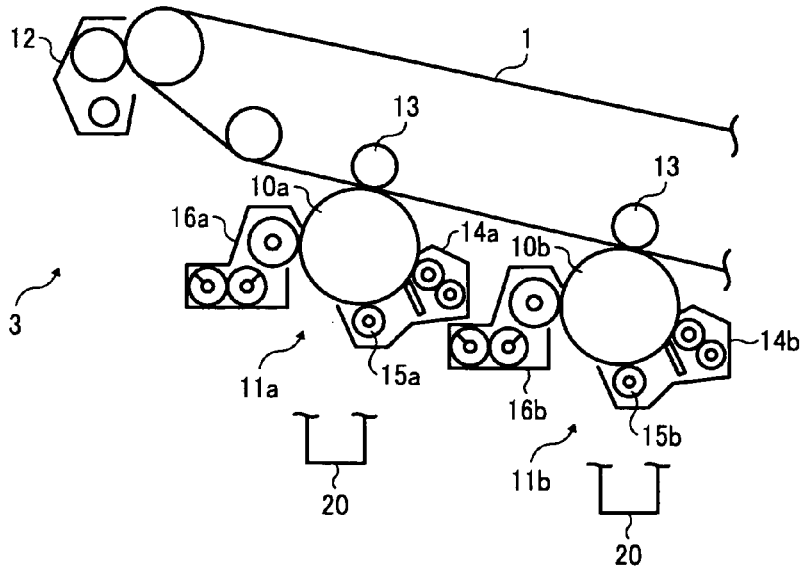
FIG. 2 is a magnified view of the relevant part of the process cartridge attached to the image forming apparatus of FIG. 1.

FIG. 1 is an overall view of an example of an image forming apparatus according to an exemplary embodiment of the present invention. FIG. 2 is a magnified view of the relevant part of a process cartridge 11 attached to the image forming apparatus 100.

The image forming apparatus 100 includes an intermediate transfer belt 1 and a plurality of toner bottles 2 disposed within a main body 3 of the image forming apparatus 100. A color toner image is formed on the intermediate transfer belt 1 using a plurality of colors. The toner bottles 2 supply toner of different colors to form the color toner image.

The image forming apparatus 100 further includes a paper feed roller 4, resist rollers 5, a secondary transfer roller 6, a fixing unit 7, and paper discharge rollers 8. Sheets of paper S are stored and piled in a paper cassette 30 disposed at the bottom of the image forming apparatus 100. The paper S is fed from the paper cassette 30 and conveyed through a conveyance path defined by the components described above such as the rollers.

The paper feed roller 4 feeds the paper S from the bottom to the top of the image forming apparatus 100. The resist roller 5 adjusts conveyance of the paper S so that it synchronizes with the toner image transfer timing. The secondary transfer roller 6 is disposed to contact the intermediate transfer belt 1 to form a nip therebetween, so that the nip provides a predetermined pressure between the secondary transfer roller 6 and the intermediate transfer belt 1. Thus, the paper S is contacted to the intermediate transfer belt 1 in a predetermined manner. The fixing unit 7 provides heat and pressure to fix the toner image onto the surface of the paper S. The paper discharge roller 8 then outputs the paper S from the image forming apparatus 100.

While the paper S is conveyed through the conveyance path, the color toner image is transferred onto the paper S, and fixed in place by the fixing unit 7. After the completion of the image forming, the paper S is output from the top of the image forming apparatus 100 by the paper discharge roller 8.

Process cartridges 11*a*, 11*b*, 11*c*, and 11*d*, each of which functions as an image forming station to form each color toner image, are disposed along the intermediate transfer belt 1 in a longitudinal direction of the intermediate transfer belt 1. The intermediate transfer belt 1 is tilted to the left in the drawing.

The image forming stations include photosensitive drums 10*a*, 10*b*, 10*c*, and 10*d* (hereinafter collectively "photosensitive drum 10"), charging devices 15*a*, 15*b*, 15*c*, and 15*d* (hereinafter collectively "charging device 15"), developing devices 16*a*, 16*b*, 16*c*, and 16*d* (hereinafter collectively "developing device 16"), and photosensitive drum cleaning devices 14*a*, 14*b*, 14*c*, and 14*d* (hereinafter referred to collectively as the cleaning device 14). The photosensitive drums 10*a*, 10*b*, 10*c*, and 10*d* are image carriers.

Four writing units 9 are disposed underneath of the process cartridges 11*a*, 11*b*, 11*c*, and 11*d*, respectively. Each writing unit 9 writes an electrostatic latent image by directing a laser light onto the photosensitive drums 10*a*, 10*b*, 10*c*, and 10*d*.

The intermediate transfer belt cleaning device 12 removes residual toner remaining on the intermediate transfer belt to clean the intermediate transfer belt 1.

In the process cartridges 11*a*, 11*b*, 11*c*, and 11*d* (collectively "process cartridge 11"), the photosensitive drum 10*a*, 10*b*, 10*c* and 10*d* may be integrated with at least one of the charging devices, the developing devices, and the cleaning devices. Further, each process cartridge 11*a*, 11*b*, 11*c*, and 11*d* detachably attachable to the main body 3 of the image forming apparatus 100.

The toner bottles 2 that supply toner to the image forming apparatus 100 is replaceable, that is, the toner bottles 2 can be attached to and detached from the image forming apparatus 100. A plurality of toner bottles 2 may be arranged for each color. The toner bottles 2 charge each color toner, i.e., yellow, cyan, magenta, black. The toner bottle 2 is connected to the development device 16 through a conveyance path (not shown), so that predetermined amount of the corresponding color toner can be supplied thereto.

In this image forming apparatus 100, when the paper S is fed forward by the paper feed roller 4 and arrives at the resist roller 5, the leading edge of the paper S is detected by a sensor (not shown). In synchronization with this detection signal, the paper S is conveyed by the resist roller 5 to the nip formed by the secondary transfer roller 6 and the intermediate transfer belt 1 so that the image formed on the intermediate transfer belt 1 is transferred onto the paper S in a secondary transfer process.

The photosensitive drum 10 is charged uniformly by the charging device 15 in advance. A laser beam is directed onto the photosensitive drum 10 from the writing unit 9 to form an electrostatic latent image on the surface of the photosensitive drum 10. The electrostatic latent image is developed by the developing device 16. As a result, a color toner image, i.e., yellow, cyan, magenta, black, is formed on the surface of the photosensitive drum 10. When a predetermined voltage is applied to a transfer roller 13, the toner images formed on the photosensitive drums 10*a*, 10*b*, 10*c*, and 10*d* are successively transferred. Each image forming operation is performed with a predetermined delay in conveyance of the intermediate transfer belt 1 so that the each color toner image can be superimposed at the same position on the intermediate transfer belt 1. The toner image formed on the intermediate transfer belt 1 is conveyed to the secondary transfer roller 6 and transferred onto the paper S secondarily. The paper S having a toner image is conveyed to a fixing unit 7, and the toner image is fixed by heat and pressure. Then, the paper S is output by the paper discharge rollers 8.

The residual toner generated during the image forming operation is collected and removed. The collected residual toner is output from the process cartridges 11*a*, 11*b*, 11*c* and 11*d*. Thus, the residual toner on the photosensitive drum 10 is removed and collected by the cleaning device 14 to clean the photosensitive drum 10. The collected residual toner is output to a toner recycling device 20 through a residual toner output tube (not shown).

Similarly, residual toner that is not transferred to the paper S but remains on the intermediate transfer belt 1 is removed by an intermediate transfer belt cleaning device 12. Consequently, the surface of the intermediate transfer belt 1 is cleaned.

Figure 4:
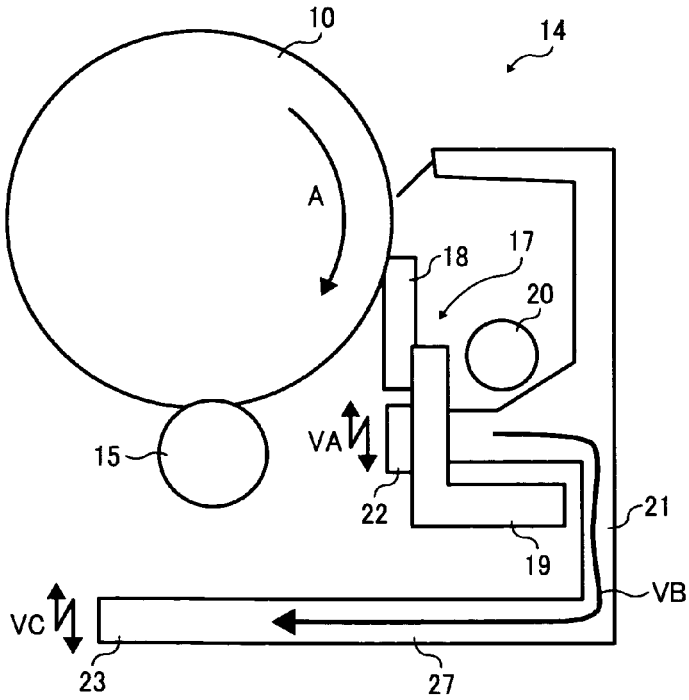
FIG. 4 is an illustration of the cleaning device to explain vibration at a cleaning frame of the cleaning device.

The cleaning device is now described. Referring to FIGS. 3 and 4, a generation mechanism of the noise generated at the cleaning frame of the cleaning device will be described.

FIG. 3 is an overall view of the cleaning device. The cleaning device includes a cleaning blade 17 and the residual toner recycling device 20 described above that collects residual toner scraped up by the cleaning blade 17. More specifically, the cleaning blade 17 is pressed to contact the photosensitive drum 10 to remove residual toner from the surface of the photosensitive drum 10. The cleaning blade 17 includes a blade 18 and a blade holder 19 that holds the blade 18. The blade holder 19 and a cleaning holder stationary member 22 (e.g. a fixing member) together attach the blade 18 to a cleaning frame 21 that is the main body of the cleaning device using, for example, a screw.

The cleaning frame 21 is extending in an axial direction of the photosensitive drum 10 that rotates in a direction indicated by arrow A. A part of the cleaning frame 21 overhangs the blade 18 and the blade holder 19 (referring to FIG. 7). The overhanging portion is defined as a cleaning frame opening 27, and the leading edge of the cleaning frame opening 27 is referred to as a cleaning frame opening leading edge 23.

A protection member may be provided around the charging device 15 to protect the charging device 15 when the cleaning device is carried during handling. The protection member may be integrated with the cleaning frame 21 to reduce the number of the parts.

Referring now to FIG. 4, how vibration of the cleaning frame 21 is generated in the cleaning device shown in FIG. 3 will be described.

As shown by arrow "VA" in FIG. 4, when the residual toner is removed, the vibration is generated by chatter created by friction between the blade 18 and the photosensitive drum 10. The vibration is transmitted to the blade holder 19 and then to the cleaning frame 21 sequentially. That is, the vibration is transmitted to the entire cleaning frame 21 as shown by arrow "VB" in FIG. 4.

Since the blade holder 19 must remain, via the cleaning blade 17, in stable contact with the photosensitive drum 10 in the axial direction of the photosensitive drum 10, the blade holder 19 may be formed of iron or be bent in a direction parallel to the axial direction of the photosensitive drum 10 for greater rigidity.

To the cleaning frame 21, the cleaning blade 17 is attached via the blade holder 19 as described above. Further, a variety of members such as the residual toner recycling device 20 may be attached to the cleaning frame 21. Accordingly, a high-flexibility resin is generally used to attach such members. As a result, the vibration becomes easy to transmit because of the resin.

The cleaning frame opening 27 is extended along the axial direction of the photosensitive drum 10 and has low rigidity compared to other parts of the cleaning frame 21 because the cleaning frame opening 27 is overhanging. In particular, the rigidity of the leading edge 23 of the cleaning frame 21 is especially low. Accordingly, the vibration is amplified (shown by arrow "VC"). As a result, much noise is generated due to the amplified vibration at the leading edge 23.

Figure 5:
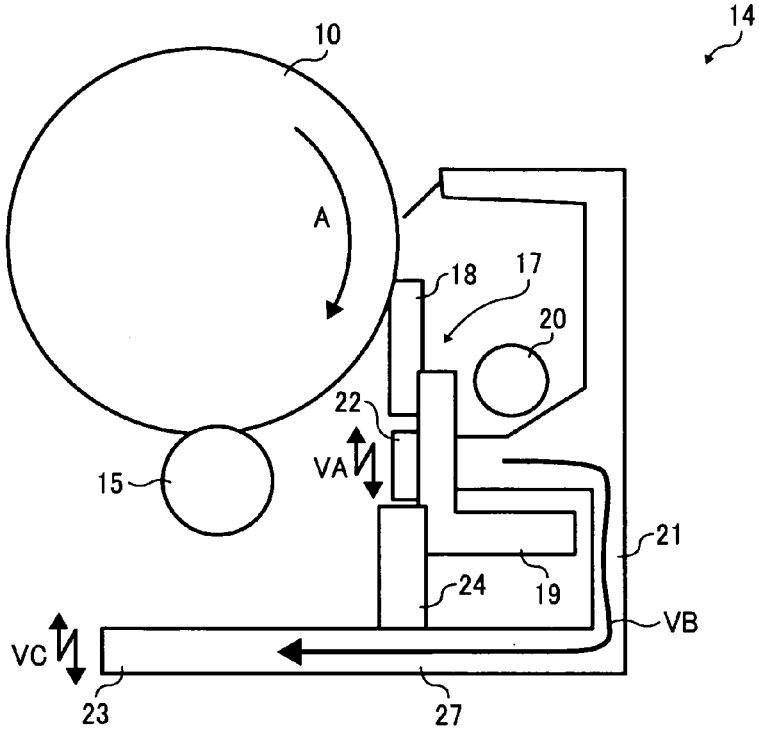
FIG. 5 is an overall view of another example of the cleaning device.
Figure 7:
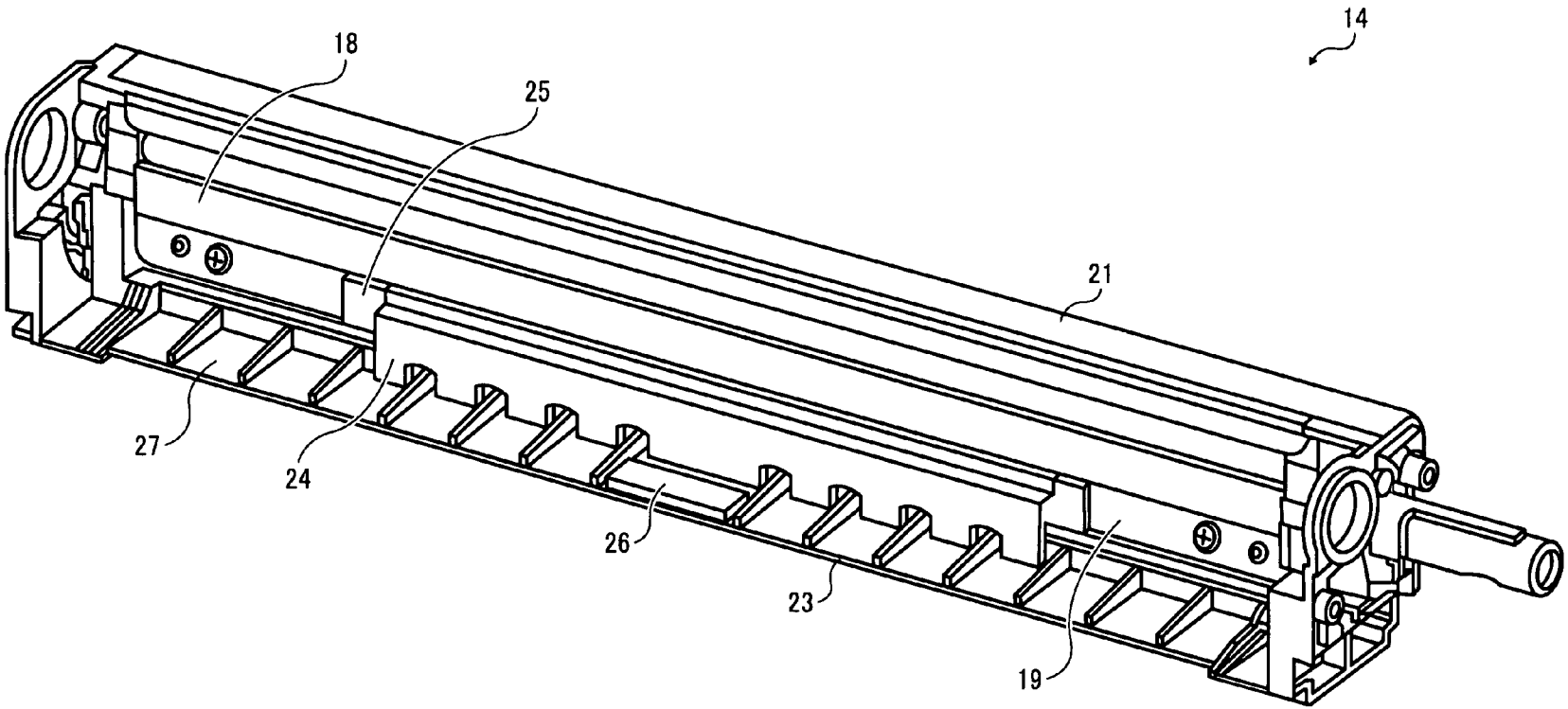
FIG. 7 is an overall view of yet another example of the cleaning device.

In the cleaning device according to the an exemplary embodiment of the present invention, as shown in FIG. 5, a vibration suppression member 24 is provided across the blade holder 19 having high rigidity and the cleaning frame 21 having low rigidity so as to couple the blade holder 19 and the cleaning frame 21 together. It may be possible to weaken the vibration if the vibration suppression member 24 is provided across any part of the blade holder 19 and any part of the cleaning frame 21. However, it is preferable that the vibration suppression member 24 be connected to a weak portion of the cleaning frame 21, for example, the cleaning frame opening 27 which has low rigidity. Consequently, the vibration is prevented more effectively. Further, it is not necessary to provide the vibration suppression member 24 along the entire length of the cleaning device 14 in the longitudinal direction of the cleaning device 14. For example, as shown in FIG. 7, the vibration suppression member 24 may be provided at only a center portion in the longitudinal direction of the cleaning device 14.

The vibration suppression member 24 may be attached to the blade holder 19 and the cleaning frame 21 by an adhesive material or by double-sided tape. As for the vibration suppression member 24, "LR-V" (a registered trademark of Bridgestone IPG Co. Ltd.) can be used. However, any other product that contributes similar vibration suppression effect can be used.

Ordinarily, the vibration of the cleaning frame 21 is amplified and the amplitude of vibration increases. However, with this configuration, vibration can be reduced because the vibration is converted to thermal energy by the vibration suppression member 24 attached to the blade holder 19, resulting in noise reduction.

Figure 6:
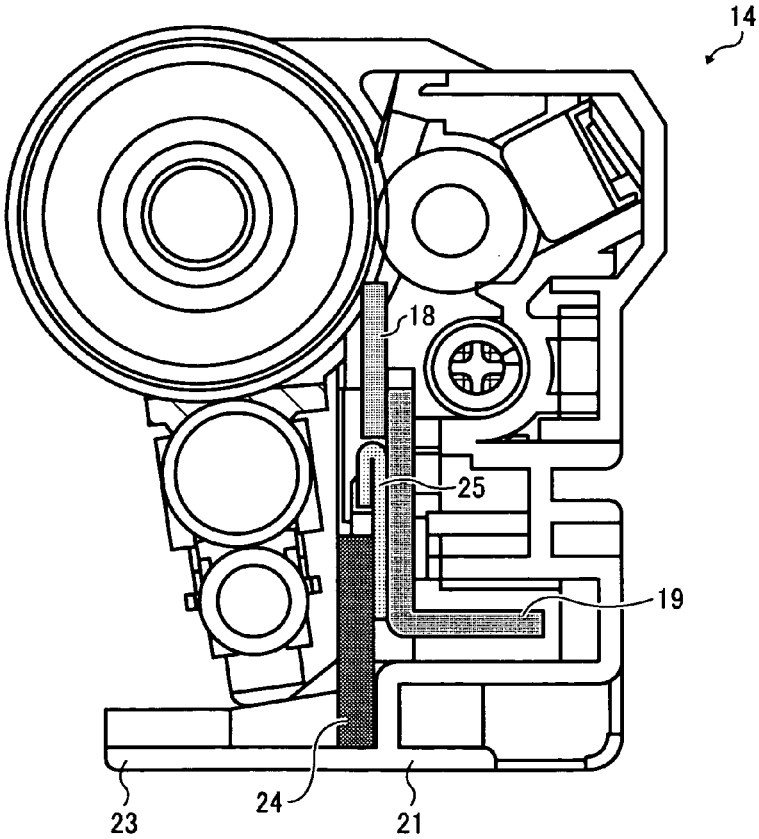
FIG. 6 is an overall view of an example of the cleaning device.

Further, as shown in FIG. 6, it is preferable to attach a weight to the blade holder 19 (hereinafter referred to as a blade holder weight 25) by, for example, double-sided tape, and provide the vibration suppression member 24 across the blade holder weight 25 and the cleaning frame 21.

By the blade holder weight 25, vibration of the blade holder 19 can be reduced. Further, vibration of the cleaning frame 21 can also be reduced, resulting in further reduction of the vibration transmitted through the cleaning frame 21.

As with the vibration suppression member 24, it is not necessary to provide the blade holder weight 25 to the whole portion in the longitude direction of the cleaning device 14. Instead, the blade holder weight 25 need only be provided at the center portion in the longitude direction of the cleaning device 14 as shown in FIG. 7.

With this configuration, vibration of the cleaning frame 21 can be reduced, resulting in effective reduction of vibration transmitted by the cleaning frame 21. As a result, noise generated at the cleaning frame 21 can be reduced effectively.

Further, as shown in FIG. 7, a weight 26 may be attached to the leading edge 23 of the cleaning frame opening 27 with a fastener such as double-sided tape. As a result, it is possible to achieve a further reduction in the vibration of the leading edge 23 of the cleaning frame 21.

It is preferable to attach the weight 26 to a center portion in the longitude direction of the cleaning device 14. When the weight 26 is attached to a center portion in the longitude direction of the cleaning device 14, it is possible to prevent vibration more effectively than in a case where a weight of equal size is attached to a portion other than the center portion.

Accordingly, with this configuration, vibration of the cleaning frame 21 can be reduced, resulting in effective reduction of vibration transmitted in the cleaning frame 21. As a result, noise generated at the cleaning frame 21 can be reduced effectively.

The cleaning device 14 is integrated with the photosensitive drum 10 to form the process cartridge 11. Since it is easy to exchange the process cartridge 11, it is possible to quickly restart printing by replacing the process cartridge 11 when the process cartridge 11 reaches the end of its safe useful life.

Numerous additional modifications and variations are possible in light of the above teachings. It is therefore to be understood that, within the scope of the appended claims, the disclosure of this patent specification may be practiced otherwise than as specifically described herein.

What is claimed is:

1. A cleaning device cleaning residual toner remaining on an image carrier, the cleaning device comprising:

a cleaning blade configured to clean the image carrier, the cleaning blade including a blade member provided to contact the surface of the image carrier, and a holder to hold the blade member;

a frame to hold the cleaning blade; and a vibration suppression member provided across the cleaning blade and the frame to couple the cleaning blade and the frame together, the vibration suppression member configured to regulate vibration of the frame transmitted from the cleaning blade, wherein the blade holder includes a weight and the vibration suppression member is provided across the weight and the frame to couple the weight and the frame together.

2. The cleaning device according to claim 1, wherein the frame has an opening portion and a weight is attached at a leading edge of the opening portion at a center portion thereof in the axial direction of the image carrier.

3. The cleaning device according to claim 1, integrally mounted with an image carrier configured to form a toner image disposed within a process cartridge removably installable in an image forming apparatus.

4. An image forming apparatus, comprising:

an image carrier configured to form a toner image; and the cleaning device according to claim 1.

5. The cleaning device according to claim 1, wherein a portion of the frame overhangs the cleaning blade.

6. A cleaning device cleaning residual toner remaining on an image carrier, the cleaning device comprising:

a cleaning blade configured to clean the image carrier, the cleaning blade including a blade member provided to contact the surface of the image carrier, and a holder to hold the blade member;

a frame to hold the cleaning blade; and a vibration suppression member configured to regulate vibration of the frame transmitted from the cleaning blade, wherein the blade holder includes a weight and the vibration suppression member is provided across the weight and the frame to couple the weight and the frame together.

7. The cleaning device according to claim 6, wherein the vibration suppression member couples the cleaning blade and the frame together.

8. The cleaning device according to claim 6, wherein the holder has a higher rigidity than the frame.

9. The cleaning device according to claim 8, wherein the holder is metal and the frame is resin.

10. The cleaning device according to claim 6, wherein the frame extends in a first direction and includes a first protruding portion protruding from the frame in a second direction, the second direction extending toward the cleaning blade relative to the first direction, and a second protruding portion protruding toward the same direction as the first protruding portion, wherein the vibration suppression member is connected to the second protruding portion and the holder.

11. The cleaning device according to claim 6, further comprising a fixing member to attach the blade member to the frame.

12. The cleaning device according to claim 6, wherein a portion of the frame overhangs the cleaning blade.

13. The cleaning device according to claim 6, wherein the blade holder includes a weight and the vibration suppression member is provided across the weight and the frame to couple the weight and the frame together.

14. The cleaning device according to claim 6, wherein the frame has an opening portion and a weight is attached at a leading edge of the opening portion at a center portion thereof in the axial direction of the image carrier.

15. The cleaning device according to claim 6, integrally mounted with an image carrier configured to form a toner image disposed within a process cartridge removably installable in an image forming apparatus.

16. An image forming apparatus, comprising:

an image carrier configured to form a toner image; and the cleaning device according to claim 6.

17. The cleaning device according to claim 1, wherein the holder has a higher rigidity than the frame.

18. The cleaning device according to claim 1, wherein the frame extends in a first direction and includes a first protruding portion protruding from the frame in a second direction, the second direction extending toward the cleaning blade relative to the first direction, and a second protruding portion protruding toward the same direction as the first protruding portion, wherein the vibration suppression member is connected to the second protruding portion and the holder.

19. The cleaning device according to claim 1, further comprising a fixing member to attach the blade member to the frame.

* * * * *